United States Patent [19]

Overmoe

[11] 4,253,287

[45] Mar. 3, 1981

[54] STEP WALKER

[76] Inventor: Kenneth R. Overmoe, 6644 Columbus Ave. South, Minneapolis, Minn. 55423

[21] Appl. No.: 52,757

[22] Filed: Jun. 28, 1979

[51] Int. Cl.[3] ..... E04F 11/18

[52] U.S. Cl. ..... 52/184; 135/65

[58] Field of Search ..... 52/184; 182/3; 135/65, 135/67

[56] References Cited

U.S. PATENT DOCUMENTS

| | | | |
|---|---|---|---|
| 802,252 | 10/1905 | Anderson | 182/3 |
| 1,785,487 | 12/1930 | McAvoy . | |
| 2,576,556 | 11/1951 | Babson . | |
| 2,782,796 | 2/1957 | Blue . | |
| 3,421,529 | 1/1969 | Vestal | 135/67 |
| 3,591,874 | 7/1971 | O'Kennedy | 5/81 |

*Primary Examiner*—J. Karl Bell

*Attorney, Agent, or Firm*—Kinney, Lange, Braddock, Westman and Fairbairn

[57] ABSTRACT

A step walker for people with walking disabilities includes a pair of parallel, spaced-apart substantially flat, vertically faced guide railings fixedly positioned above either side of a stairway to lie in parallel relation to the stairway. Each railing is provided with a guide slot extending from top to bottom of the railing. These guide slots are defined by a plurality of ramp sections extending in direction up the stairway from a lower to an upper portion of the railing, and a plurality of ratchet tooth holding sections, one between each ramp section, the ratchet tooth holding sections extending in direction up the stairway from an upper portion to a lower portion of the railing. A walking bar slides in these guide slots to be brought to rest at the bottom end of each holding section so that the step walker user can support his weight on the bar while moving up or down from one step to the next. The user will then situate the walking bar in the bottom of the next adjacent holding section and use it as before to advance to the next step.

9 Claims, 5 Drawing Figures

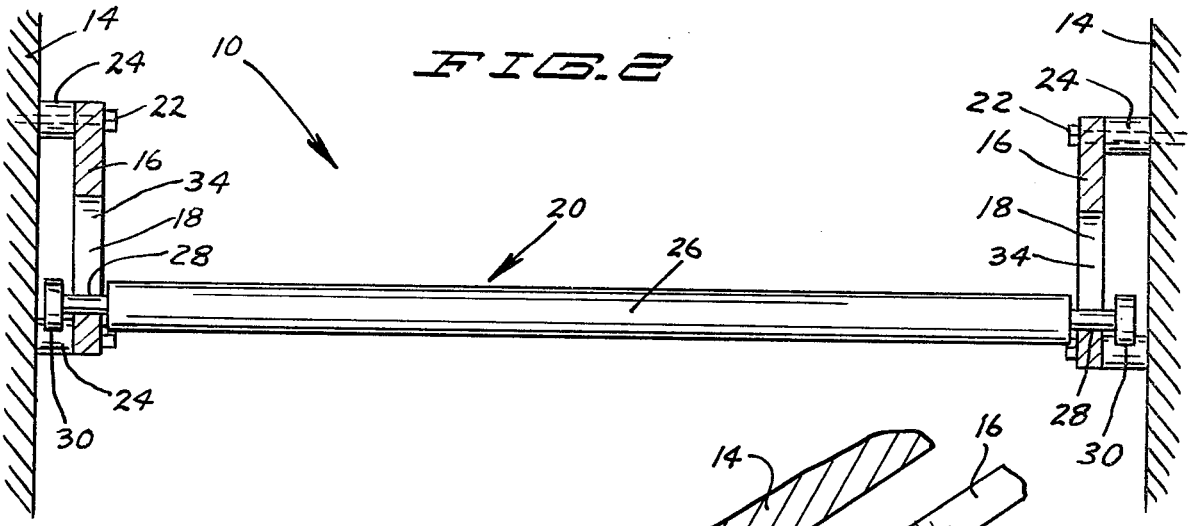
FIG. 2
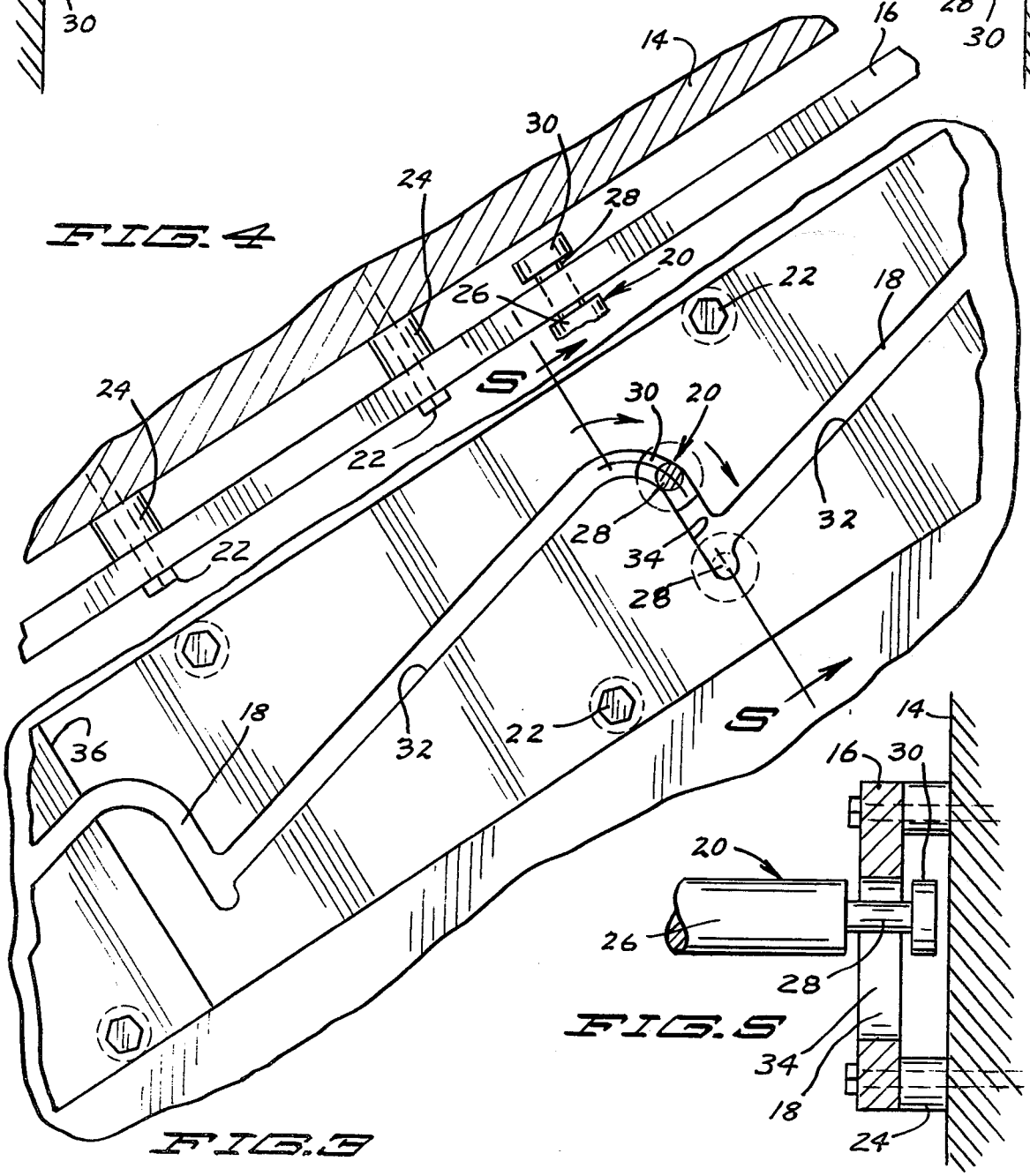
FIG. 4
FIG. 3
FIG. 5

STEP WALKER

BACKGROUND OF THE INVENTION

This invention has relation to an apparatus for aiding a person needing a walker to be able to travel up and down stairs. It has long been known to provide stands for use by persons not able to walk without help. Such stands customarily are of lightweight metal and have four legs supported on the floor with appropriate bars innerconnecting the legs at a top portion, these bars being positioned at a height where a person needing aid can reach them from a wheelchair and can, when pulled to an upright position, lean on them while walking. The walkers are picked up and set ahead by the person using them so such person can lean on the walker in taking the next step(s).

As far as structure is concerned, walkers of the prior art will operate in the same manner as the walker in the condition illustrated at FIG. 1 in U.S. Pat. No. 3,421,529 granted in January of 1969 to Vestal.

Such walkers have been very important over the years in giving a person with a walking difficulty an ability to move around on one floor, and this has been important practically from the standpoint of the person's well-being and psychologically from the standpoint of giving a certain feeling of independence. Such aids have, however, allowed such disadvantaged persons to move effectively only on the floor on which they are situated; so that small nursing homes and hospitals and like institutions have very often been designed as single story structures, or have been required to go to the expense of providing elevator service where more than one floor is used.

More importantly, most such disadvantaged persons live primarily in private homes, and such persons have, before the present invention, been confined to one story of such homes except for relatively rare occasions when one or more persons are available to help them up or down the stairs to another story. In much too large a number of cases, this results in the older or other disadvantaged person living out a very major portion of his or her life on an upper story without substantial meaningful contact with people other than the immediate family.

In an attempt to alleviate this problem, efforts have been made to provide structures which will aid persons with walking disabilities or difficulties to traverse stairways.

These include the aforementioned patent to Vestal, in which an elaborate walker is so designed that it can be manually adjusted to provide bearing surfaces on three steps of a stairway at the same time, thus attempting to provide a contraption which the user can lift up or down from one step to the next while lifting himself up or down in between movements of the walker. See FIG. 3 of Vestal.

Among the difficulties with the Vestal apparatus is the fact that the person using this "paraplegic aid" must lift it from step to step and, in so doing, may lose his balance and suffer a severe fall. Further, when arriving at the top or the bottom of the stairway, there is no effective way to adjust the structure from the position as seen in FIG. 3 to the position as seen in FIG. 1 without balancing at the top or bottom step and having to reach down to manually operate the locking devices such as those shown at 48 and 60. It would appear that, in most cases, the ability to operated the paraplegic aid to convert it from stepwalking to floorwalking configuration is beyond the capabilities of the disadvantaged person using it.

U.S. Pat. No. 1,785,487 granted to McAvoy in December of 1930 discloses a gate which is mounted across the stairway and is supported in a rail for sliding movement down and up a stairway. The idea is to have a brake mechanism on the gate so that a person can walk down the stairway leaning on the gate. This brake mechanism limits the rate of speed with which the gate can move downwardly. The apparatus is biased in such a manner that when the gate is released at the bottom, it will travel by itself up to the top of the stairs to be ready for the next person coming down.

The McAvoy structure is obviously expensive to install and is effective only to aid people in coming from the top toward the bottom of the stairway. It is in reality only a safety device to prevent people from losing their balance and falling on the way downstairs. The user has no control over rate of descent, and if it were too fast for his capabilities, he would have to "hang on" and literally ride down on the gate.

Presumably a disadvantaged person moving up the stairs would have to use the ordinary railings provided, and would, upon reaching the closed gate, have to lift it vertically upwardly and then back down a step or two to swing the gate toward him to obtain access to the room at the top of the stairs. This would appear to be an expensive and dangerous means of attempting to provide assistance for disadvantaged persons in navigating stairways.

U.S. Pat. No. 2,782,796 granted in February of 1957 to Blue, shows a very simple walking stick or cane type arrangement having an elongated block 12 providing a platform surface so that the cane or stair-walking aid will be free standing. The disadvantaged person utilizes the device substantially like a cane being used on a flat surface. The lack of stability of such a device for walking up or down stairs is evident. The device will provide no help if any substantial unbalance should occur, and, in that case, a dangerous fall will be inevitable.

U.S. Pat. No. 2,576,556 granted in November of 1951 to Babson discloses a escalator-like hand rail which moves continuously in an upward direction along either side of a stairway to allow someone walking up the stairs to support weight thereon so that the walking will be less arduous. The obvious disadvantage to this structure in assisting persons to move from a lower floor to an upper floor is that the speed of the hand rails is constant and continuous, and a person who must in effect think about each move and gather resources before making that move could not use the device. There is no provision for allowing people to move down a stairway with the help of the movable hand rail. Even if the direction of the hand rail were reversed for such use, there would be no facility to go up to the top until the drive was again reversed.

U.S. Pat. No. 3,591,874 granted in July of 1971 to O'Kennedy shows a structural aid for an individual consisting of a bar supported over a frame adapted to be gripped by the individual when in seated position and useful to allow the invalid to raise himself from seated to standing position. Other than showing the use of a bar to support the weight of a person having a disability or difficulty in movement, it is not believed to be pertinent to the invention.

From the above summary, it is evident that no prior art device or apparatus provides a structure which is positively positioned against forward or backward movement to bear substantially the entire weight of a user while moving up or down one step at a time, and which can be very easily moved ahead up or down the width of a single step by the user while standing firmly on one step in preparation for taking the next step up or down.

The applicant caused a preliminary search to be made on the invention, and the five patents referred to above were all of the patents located in the search. Applicant and those in privity with him know of no closer prior art than that set out above; and they know of no prior art which anticipates the claim made in this application.

BRIEF SUMMARY OF THE INVENTION

A step walker of the present invention is for the purpose of aiding persons with walking disabilities or difficulties to move up and down stairs with the aid of a horizontally positioned walking bar which can easily be moved along the stairway the dimension of one step width at a time.

Such a step walker includes a pair of parallel, spaced-apart guide railings situated at an appropriate distance above the stairs of a stairway and extending upwardly from the bottom of the stairway toward the top along a line parallel to the pitch of the stairs in the stairway.

Each such guide railing is provided with a guideway or guide slot, and a walking bar extending between the guide railings is positioned in the guideway or guide slot for longitudinal movement along the guide railings.

The outer ends of the walking bar are of dimension to extend into the guideways and to move along them freely. The guideway of one of the guide railings is in exact parallel relationship with the guideway of the other guide railing. Each guideway is made up of a plurality of elongated ramp sections and connected ratchet tooth holding sections. The overall horizontal distance from the beginning of each ramp section to the end of its adjacent ratchet tooth section is equivalent in horizontally measured dimension to the horizontal depth of each of the steps of the stairway.

Each ramp section extends in direction up the stairway from a lower to an upper portion of the guide railing at an angle greater than that of the railing itself with respect to the horizontal. Each ratchet tooth holding section extends in direction up the stairway from an upper to a lower portion of the railing at an angle substantially less than horizontal. The configuration and angle of this ratchet tooth holding section will be such that with the walking bar situated at a bottom of a pair of mutually aligned ratchet tooth holding sections, the weight of a person using the step walker can be placed on the walking bar without any tendency for movement of the walking bar in direction upwardly or downwardly along the guide railings.

IN THE DRAWINGS

FIG. 2 is an enlarged sectional view taken on the line 2—2 in FIG. 1;

FIG. 3 is an enlarged fragmentary view of the side wall and elongated guide railing as seen in FIG. 1 showing progressive positions of the walking bar with respect to the guide railing when the step walker is in use;

FIG. 4 is a top plan view of the elongated guide railing and walking bar as seen in FIG. 3 with the vertical side wall being shown in section; and FIG. 5 is an enlarged vertical sectional view taken on the line 5—5 in FIG. 4, and showing the opposite guide rail and vertical from that seen in FIG. 4.

DESCRIPTION OF PREFERRED EMBODIMENT

Figure 1:
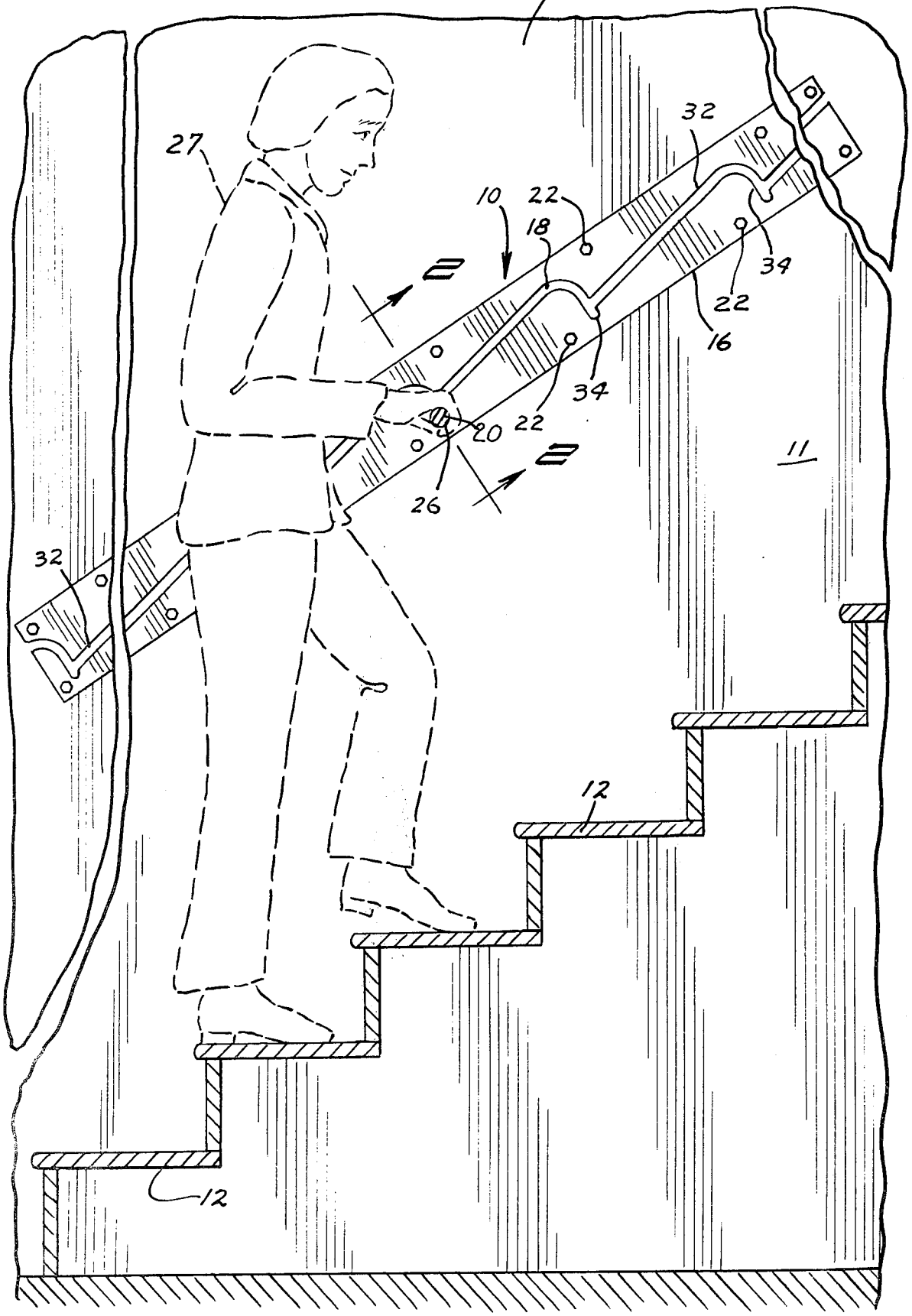
FIG. 1 is a transverse vertical sectional view of a stairway showing one of two vertical side walls with a guide railing of the invention mounted thereon and showing in vertical section a walking bar of the invention positioned with respect to the guide railing, a walker using the step walker of the invention being shown in phantom with respect thereto.

A step walker 16 of the present invention is illustrated in connection with a stairway 11 extending upwardly and downwardly at an acute angle or slope with respect to horizontal and having vertically spaced and horizontally offset steps or treads 12 and vertical, parallel, spaced-apart side walls 14,14. The step walker includes a pair of elongated guide railings 16,16 generally parallel to the angle of the steps and each provided with a guide slot or guideway 18 therein, and a walking bar 20 temporarily positioned within each of the guide slots but slidable longitudinally of each of the guide railings within those slots.

As most clearly seen in FIGS. 2 and 4, the guide railings 16,16 in the embodiment of the invention as shown, are firmly mounted with respect to side walls 14,14 through the instrumentality of lag screws 22 and hollow dowel rod sections 24 which hold the guide railings firmly in spaced relationship to the side walls.

The walking bar 20 includes a central cylindrical hand-hold shaft 26 designed to be held and manipulated in the hands of the person 27 using the walker, a pair of guide and holding pins 28,28 each extending integrally outwardly from one end of the cylindrical hand-hold shaft 26 in concentric relation thereto, and a pair of disc shaped retaining heads 30,30 extending integrally and concentrically outwardly from each of the guide pins 28,28.

The diameter of the cylindrical hand-hold shaft 26 will be such as to be conveniently and easily held and manipulated by a person using the step walker. Conceivably this diameter or shape could be adopted to the capabilities and abilities of the particular individual using it.

The diameter of the guide and holding pins 28,28 will be substantially equal to the width of the guide slot 18 in the railings 16,16 except that the diameter of the pins will be small enough so that the walking bar can be moved easily along the guide slots without binding.

The diameter of the retaining heads 30,30 will be such that the guide and holding pins 28,28 cannot be removed from the elongated guide railings except at the termination of those railings at the top and bottom of the stairway.

Each guide slot 18 in each elongated guide railing includes an elongated ramp section 32 extending in direction up the stairway from a lower to an upper portion of the railing at an angle greater than the angle of the railing itself with respect to horizontal. Each guide slot also includes a ratchet tooth holding section 34 extending in direction up the stairway from an upper to a lower portion of the railing at an angle with respect to the horizontal such that with the pins 28,28 of the walking bar 20 situated at the bottom of a pair of aligned ratchet tooth holding sections 34, the weight of a person using the step walker can be placed on the hand-hold shaft of the walking bar without movement of the walking bar in upward or downward direction along the guide railings 16,16.

When the elongated guide railings 16,16 are to be located on a stairway longer than the individual portions of those guide railings, such railing sections can be butted together as at 36.

OPERATION

In operation, the person desiring to use the step walker to move from the bottom to top of stairway 11 will insert the walking bar 20 into the elongated guide railings 16,16 at the lower left end of the guide railings as seen in FIG. 1. When this is done, the walking bar will fall or be moved to have position at the very bottom of the first ratchet tooth holding section 34 at the left end of the guide railings. To utilize the step walker, the disadvantaged person will stand on the lower floor up close to the walking bar and will move it up the elongated ramp section 32 and over onto the next adjacent ratchet tooth holding section 34 where the walking bar will come to rest at the bottom of that holding section. The user will then be able to put his weight on the central cylindrical hand-hold shaft 26 of the walking bar and, with this aid, lift first one foot and then the other up the first step of the stairway. The user will then repeat this procedure as to each step until arriving at the top of the stairway. The guide railing will continue up past the top of the stairway far enough so that the user is firmly and safely on the upper floor before removing the walking bar from the guide rails.

Once the walking bar is removed from the guide rails, it can be stored at a location adjacent the top of the stairway until such time as the user wishes to go downstairs. Having arrived at the top of the stairs, the user can then revert to the use of a walker of the prior art which stays on that floor.

When the person with the walking disability wishes to descend the staircase, he inserts his walking bar into the guide rail and allows it to slide down the elongated ramp section to find its position at the bottom of the first adjacent ratchet tooth holding section. At this point, he can put his weight on the walking bar and move down one step from the top of the stairway. The walking bar is then positioned by him another step in downward direction, and this process is continued until he reaches the bottom of the staircase. The guide rails will continue past the stairway sufficiently so that he is firmly on the bottom floor before he removes his walking bar from the guide rails. The walking bar can be stored adjacent the bottom of the stairway until such time as he wants to go back upstairs.

By providing individual walking bars for each of the persons at any time wishing to have help in navigating a particular stairway and by providing storage places such, for example, as old-fashioned umbrella stands, both adjacent the bottom of the stairway and adjacent the top of the stairway, there is never any problem about having the apparatus in condition for use by these persons in either upward or downward direction.

In the form of invention as shown, the bottommost portion of the ratchet tooth holding section 34 extends below the lower end of the elongated ramp section 32 to form a positive depression to firmly prevent the guide and holding pins 28,28 from being able to move either in upward or downward direction with respect to the guide rails while the user has his weight on the central hand-hold shaft 26. Also, the connection between the top ends of the elongated ramp sections 32 and their adjacent ratchet tooth holding sections 34 is shown to be gently rounded. It is to be understood that this particular shape is not essential to the invention, and that the invention would work for its intended purpose if these ratchet tooth sections and ramp sections were of other configurations. For example, the elongated ramp section could be straight from bottom to top and the ratchet tooth holding section could be straight from top to bottom, with the bottom of the ratchet tooth holding section being indentical with the bottom of the next higher adjacent elongated ramp section.

The guideways or slots 18 in each of the guide railings 16,16 are shown as extending clear through those railings. A step walker of the invention would work effectively whether or not the guide slot extended clear through the railings as long as provision was made for the outer ends of the walking bar to extend into the guide slot.

The embodiments of the invention in which an exclusive property or privilege is claimed are defined as follows:

1. A step walker for use by persons needing support while moving up and down a stairway sloped at an acute angle with respect to horizontal, said step walker including:

A. a pair of parallel, spaced-apart elongated guide railings fixedly positioned above and on either side of a stairway and having substantially the same slope as that of the stairway;

B. each of said railings being provided with a guideway open toward the other railing and extending from the lower end to the upper end of its railing and lying in exact parallel relationship to the corresponding guideway in the other railing;

C. each such guideway being defined by a plurality of elongated ramp sections extending in direction up the stairway from a lower toward an upper portion of its railing at an angle greater than the slope of the stairway with respect to the horizontal, and being further defined by a plurality of ratchet tooth holding sections each extending between adjacent ends of adjacent ramp sections;

D. a walking bar of dimension and configuration to be extended at a right angle with respect to said guide railings from position in contact with one guideway, across the stairway to position in contact with the other guideway, and of dimension and configuration to be slideable freely along said guideways; and E. wherein the angle and shape of the ratchet tooth holding sections is such that any downward component of force exerted on the walking bar while it is vertically above a pair of said ratchet sections will tend to cause the bar to slide down the ratchet sections to position of arrest at the lowest end of the next adjacent uphill ramp sections.

2. The step walker of claim 1 wherein:

F. said guideways are constituted as guide slots of substantially uniform transverse dimension and are defined by parallel, spaced-apart upper and lower ramp section defining surfaces and upper and lower ratchet tooth section defining surfaces.

3. The step walker of claim 2 wherein:

G. said walking bar includes a central hand-hold shaft extending between facing surfaces of the guide railings, and a pair of guide and holding pins each concentric with and extending outwardly from one of the ends of said hand-hold shaft and being of configuration to fit into and to freely move along one of said guide slots.

4. The step walker of claim 3 wherein:

H. each of said guide and holding pins has an integral retaining head thereon in concentric relation to the holding pin and of dimension greater than the transverse dimension of its associated guide slot.

5. The step walker of claim 3 wherein:

H. said hand-held shaft is of transverse dimension greater than the transverse dimension of the guide slots.

6. The step walker of claim 3 wherein:

H. said guide railings define at least one set of adjacent ramp and ratchet tooth holding sections for each step in the stairway; and I. each of said pair of adjacent ramp sections and ratchet tooth holding sections are of the same horizontal dimensions as that of every other such pair.

7. The step walker of claim 4 wherein:

H. the hand-hold shaft is constituted as a cylindrical bar.

8. The step walker of claim 7 wherein:

I. the guide and holding pins are of uniform cylindrical dimension.

9. The step walker of claim 8 wherein:

J. each of retaining heads is constituted as a cylindrical disc-shape member.

* * * * *